US006831547B2

(12) United States Patent
Watarai et al.

(10) Patent No.: US 6,831,547 B2
(45) Date of Patent: Dec. 14, 2004

(54) VEHICLE EQUIPMENT REMOTE CONTROL SYSTEM

(75) Inventors: Sadanori Watarai, Miyazaki (JP); Masahiko Sueyoshi, Miyazaki (JP); Tsutomu Kurita, Miyazaki (JP); Kazuya Karino, Miyazaki (JP); Suguru Asakura, Saitama (JP); Akira Kamikura, Saitama (JP); Kentaro Yoshimura, Saitama (JP)

(73) Assignees: Kabushiki Kaisha Honda Lock, Miyazaki (JP); Honda Giken Kogyo Kabushiki Kaisha, Tokyo (JP)

( * ) Notice: Subject to any disclaimer, the term of this patent is extended or adjusted under 35 U.S.C. 154(b) by 334 days.

(21) Appl. No.: 10/187,412

(22) Filed: Jul. 2, 2002

(65) Prior Publication Data

US 2003/0038732 A1 Feb. 27, 2003

(30) Foreign Application Priority Data

Jul. 5, 2001 (JP) ..... 2001-205156

(51) Int. Cl.[7] ..... E05B 49/00
(52) U.S. Cl. ..... 340/5.61; 340/10.2
(58) Field of Search ..... 340/5.61, 5.72, 340/10.2; 307/10.1, 10.2, 10.3, 10.4, 10.5, 10.6

(56) References Cited

U.S. PATENT DOCUMENTS 4,646,082 A * 2/1987 Engel et al. ..... 340/10.2
5,206,639 A * 4/1993 Kamens ..... 340/10.33
5,499,022 A * 3/1996 Boschini ..... 340/5.62
6,100,603 A * 8/2000 Gold ..... 307/10.2
6,208,239 B1 * 3/2001 Muller et al. ..... 340/10.1
6,218,932 B1 * 4/2001 Stippler ..... 307/10.2
6,496,100 B1 * 12/2002 Hiebl ..... 340/5.61
6,522,027 B1 * 2/2003 Morillon et al. ..... 340/5.72
6,538,560 B1 * 3/2003 Stobbe et al. ..... 340/5.72
6,552,649 B1 * 4/2003 Okada et al. ..... 340/5.61
2001/0033222 A1 * 10/2001 Nowottnick et al. ..... 340/5.61

FOREIGN PATENT DOCUMENTS

JP 10-308149 11/1998
JP 11-336394 12/1999

* cited by examiner

*Primary Examiner*—Brian Zimmerman
(74) *Attorney, Agent, or Firm*—Arent Fox, PLLC.

(57) ABSTRACT

A vehicle equipment remote control system includes an electronic control unit that controls the transmission from vehicle exterior transmitters and a vehicle interior transmitter such that, when one of switchover intention detection means detects a vehicle user's intention to switch over a door between a locked state and an unlocked state, among the vehicle exterior transmitters, the vehicle exterior transmitter on the side where the switchover intention detection means that has detected the switchover intention is located transmits a request signal requesting reply data, and a prohibition signal is transmitted from at least one of the remaining vehicle exterior transmitter and the vehicle interior transmitter to prohibit the transmission of reply data from the portable transceiver, the prohibition signal being at a low output level that cannot be received by the portable transceiver that is present on the side where the switchover intention detection means that has detected the switchover intention is located.

3 Claims, 4 Drawing Sheets

VEHICLE EQUIPMENT REMOTE CONTROL SYSTEM

BACKGROUND OF THE INVENTION

1. Field of the Invention

The present invention relates to an improvement of a vehicle equipment remote control system that automatically releases a locked state of a door in response to a vehicle user carrying a portable transceiver approaching the vehicle to get into the vehicle; enables the steering to be operated by releasing a steering lock when the vehicle user carrying the portable transceiver gets into the vehicle; and automatically puts the door in a locked state in response to the vehicle user carrying the portable transceiver moving away from the vehicle.

2. Description of the Related Art

Conventionally, such a system is known in, for example, Japanese Patent Application Laid-open No. 11-336394. Furthermore, switchover intention detection means is known in, for example, Japanese Patent Application Laid-open No. 10-308149 wherein, in order to obtain a trigger signal to automatically release a locked state of a door to unlock the door, the switchover intention detection means confirms the intention of a vehicle user to switch over from the locked state to an unlocked state by, for example, detecting that the vehicle user has touched an outer handle.

In order that interference between portable transceivers may be prevented when there are a plurality of portable transceivers corresponding to the vehicle in the vicinity thereof, and in order that the doors may be prevented from being automatically locked when the vehicle user gets out of the vehicle while leaving a portable transceiver within the occupant compartment, ideally vehicle exterior transmitters positioned on left and right outer sides of an occupant compartment can only communicate with a portable transceiver that is on the left or right side of the vehicle, and a vehicle interior transmitter positioned within the occupant compartment can only communicate with a portable transceiver that is present within the occupant compartment.

Since the vehicle exterior transmitters positioned on the left and right outer sides of the occupant compartment are required to have their transmission output increased to the statutory level because of the necessity to increase the distance over which communication is possible, they can also communicate with a portable transceiver that is present within the occupant compartment. In order to carry out bidirectional communication upon identifying whether a portable transceiver is present within the occupant compartment or outside the vehicle on the left or right, communication is conventionally carried out between the portable transceiver and each of the vehicle exterior transmitters and the vehicle interior transmitter so as to identify the portable transceiver that is the target of communication.

However, if identification of a portable transceiver as the target of communication is carried out by the conventional method, communication takes comparatively long time. Therefore, the responsiveness of system operation cannot be excellent, leading to a possibility that, for example, if a vehicle user opens a door quickly to get into the vehicle, the locked state of the door may not be released in time to open the door.

SUMMARY OF THE INVENTION

The present invention has been achieved in view of the above-mentioned circumstances, and it is an object of the present invention to provide a vehicle equipment remote control system that can quickly identify the portable transceiver that is the target of communication, thereby enhancing the responsiveness of system operation.

In order to accomplish the object, in accordance with a first aspect of the present invention, there is proposed a vehicle equipment remote control system comprising: vehicle exterior transmitters disposed on at least both left and right outer sides of an occupant compartment in a vehicle; a vehicle interior transmitter disposed within the occupant compartment; a vehicle receiver disposed in the vehicle; a portable transceiver that transmits reply data in response to reception of a request signal requesting reply data from each of the transmitters; door lock means for switching over doors on both the left and right sides of the vehicle between a locked state and a unlocked state; switchover intention detection means that are mounted in the doors on the left and right sides and can detect a vehicle user's intention to switch over the doors between the locked state and the unlocked state; and an electronic control unit mounted in the vehicle so as to control the operation of the door lock means in response to the detection output of the switchover intention detection means and the reception output of the vehicle receiver and to control the transmission from the vehicle exterior and interior transmitters; wherein, when the vehicle prompts the transmission of reply data from the portable transceiver, the electronic control unit controls the transmissions from the vehicle exterior transmitters and the vehicle interior transmitter such that, if one of the switchover intention detection means on the left and right sides detects the vehicle user's intention to switch over the doors between the locked state and the unlocked state, the vehicle exterior transmitter on the side where the switchover intention detection means that has detected the switchover intention is located transmits a request signal requesting reply data, and at least one of the remaining vehicle exterior transmitter and the vehicle interior transmitter transmits a prohibition signal to prohibit the transmission of reply data from the portable transceiver, the prohibition signal being at a low output level that cannot be received by the portable transceiver that is present on the side where the switchover intention detection means that has detected the switchover intention is located, among the left and right sides on the outside of the vehicle.

In accordance with this arrangement, when the portable transceiver is present outside the vehicle, as a result of detection of the vehicle user's switchover intention by the switchover intention detection means mounted in the doors on both the left and right sides of the vehicle, reply data is transmitted from the portable transceiver to the vehicle receiver in response to a request signal requesting reply data from the vehicle exterior transmitter on the side where the switchover intention detection means that has detected the switchover intention is located. At least one of a portable transceiver within the occupant compartment and a portable transceiver on the side opposite to the side where the switchover intention detection means that has detected the switchover intention is located, receives the prohibition signal and does not transmit reply data. It is therefore possible to quickly identify whether the portable transceiver is located on the left or right side of the vehicle, thereby enhancing the responsiveness of system operation. Furthermore, interference with any portable transceiver other than the identified portable transceiver can be prevented and the doors can be switched over quickly between the locked and unlocked states. Moreover, since the prohibition signal is transmitted at a low output level that cannot be received by the portable transceiver on the side where the switchover intention detection means that has detected the switchover intention is located, communication between the portable transceiver that has been identified as the target of communication and the vehicle receiver will not be impaired by the prohibition signal.

In accordance with a second aspect of the present invention, in addition to the first aspect, there is proposed a vehicle equipment remote control system wherein the electronic control unit controls the transmission of the vehicle exterior transmitters and the vehicle interior transmitter so as to transmit the prohibition signal within a predetermined period of time after transmission of the request signal is completed, and the portable transceiver transmits reply data on the condition that it has not received the prohibition signal during the predetermined period of time after receiving the request signal. In accordance with such an arrangement, since the prohibition signal does not reach the portable transceiver on the side where the switchover intention detection means that has detected the switchover intention is located, the portable transceiver transmits reply data to the vehicle receiver after the predetermined period of time following completion of reception of the request signal. The other portable transceivers receive the prohibition signal and are thereby prohibited from transmitting reply data. Therefore, identification of the portable transceiver that is the target of communication can be conducted easily.

In accordance with a third aspect of the present invention, in addition to the first or second aspect, there is proposed a vehicle equipment remote control system wherein the electronic control unit controls the transmission from the vehicle exterior transmitters and the vehicle interior transmitter by transmitting the prohibition signal during transmission of the request signal. In accordance with such an arrangement, while the portable transceiver that is present on the side where the switchover intention detection means that has detected the switchover intention is located, is receiving the request signal, the other portable transceivers receive the request signal and the prohibition signal at the same time, and since the request signal cannot be received properly, no response will be made, thereby quickly identifying the portable transceiver that is the target of communication.

The above-mentioned object, other objects, characteristics and advantages of the present invention will become apparent from an explanation of a preferred embodiment that will be described in detail below by reference to the attached drawings.

BRIEF DESCRIPTION OF THE DRAWINGS

FIG. 1 is a diagram showing the arrangement of a vehicle equipment remote control system.

FIG. 2 is a flow chart showing a transmission control procedure of an electronic control unit.

FIG. 3 is a flow chart showing a transmission control procedure of a portable transceiver.

FIG. 4 is a timing chart.

DESCRIPTION OF PREFERRED EMBODIMENTS

Figure 1:
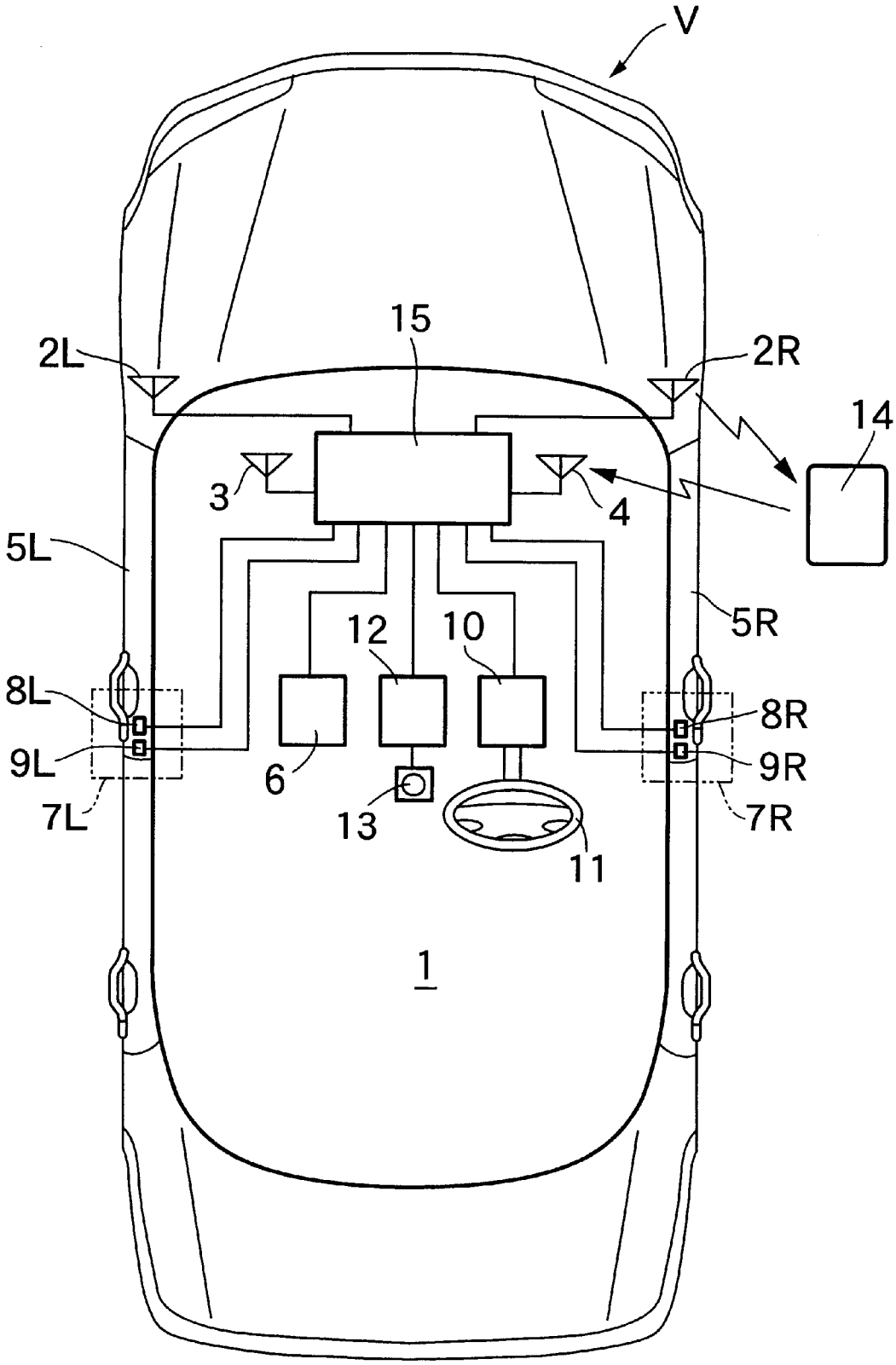
FIGS. 1 to 4 show one embodiment of the present invention.

Referring to FIG. 1, a vehicle V is provided with vehicle exterior transmitters 2L and 2R on the left and right outer sides of an occupant compartment 1, and with a vehicle interior transmitter 3 and a vehicle receiver 4 within the occupant compartment 1.

Doors 5L and 5R on the left and right sides of the vehicle V can be switched over automatically between a locked state and an unlocked state by door lock means 6. Mounted on the outer sides of the doors 5L and 5R are switchover intention detection means 7L and 7R respectively for detecting a vehicle user's intention to switch over the doors 5L and 5R between the locked state and the unlocked state. The switchover intention detection means 7L and 7R are formed from unlock switches 8L and 8R for detecting an intention to switch over from the locked state to the unlocked state by being touched by the vehicle user when getting into the vehicle; and lock switches 9L and 9R for detecting an intention to switch over from the unlocked state to the locked state by being operated by the vehicle user when getting out of the vehicle.

Within the occupant compartment 1, the vehicle V is provided with steering lock means 10 and engine start control means 12, which are equipment operation lock means for switching over between permitting and prohibiting the operation of operating equipment accompanying the operation of an operating member. The steering lock means 10 is arranged so as to switch over between permitting and prohibiting operation of the steering accompanying operation of a steering wheel 11 which is an operating member. The engine start control means 12 is arranged so as to switch over between permitting and prohibiting starting of the engine accompanying operation of a start button 13 which is an operating member.

A portable transceiver 14 carried by the vehicle user transmits reply data to the vehicle receiver 4 in response to the reception of a request signal in normal code from one of the transmitters 2L, 2R and 3 provided in the vehicle V.

The operations of the door lock means 6, the steering lock means 10, and the engine start control means 12 are controlled by an electronic control unit 15 installed in the vehicle V. The transmissions from the transmitters 2L, 2R and 3 are also controlled by the electronic control unit 15. The detection output of the switchover intention detection means 7L and 7R and the reception output of the vehicle receiver 4 are input into the electronic control unit 15.

Figure 2:
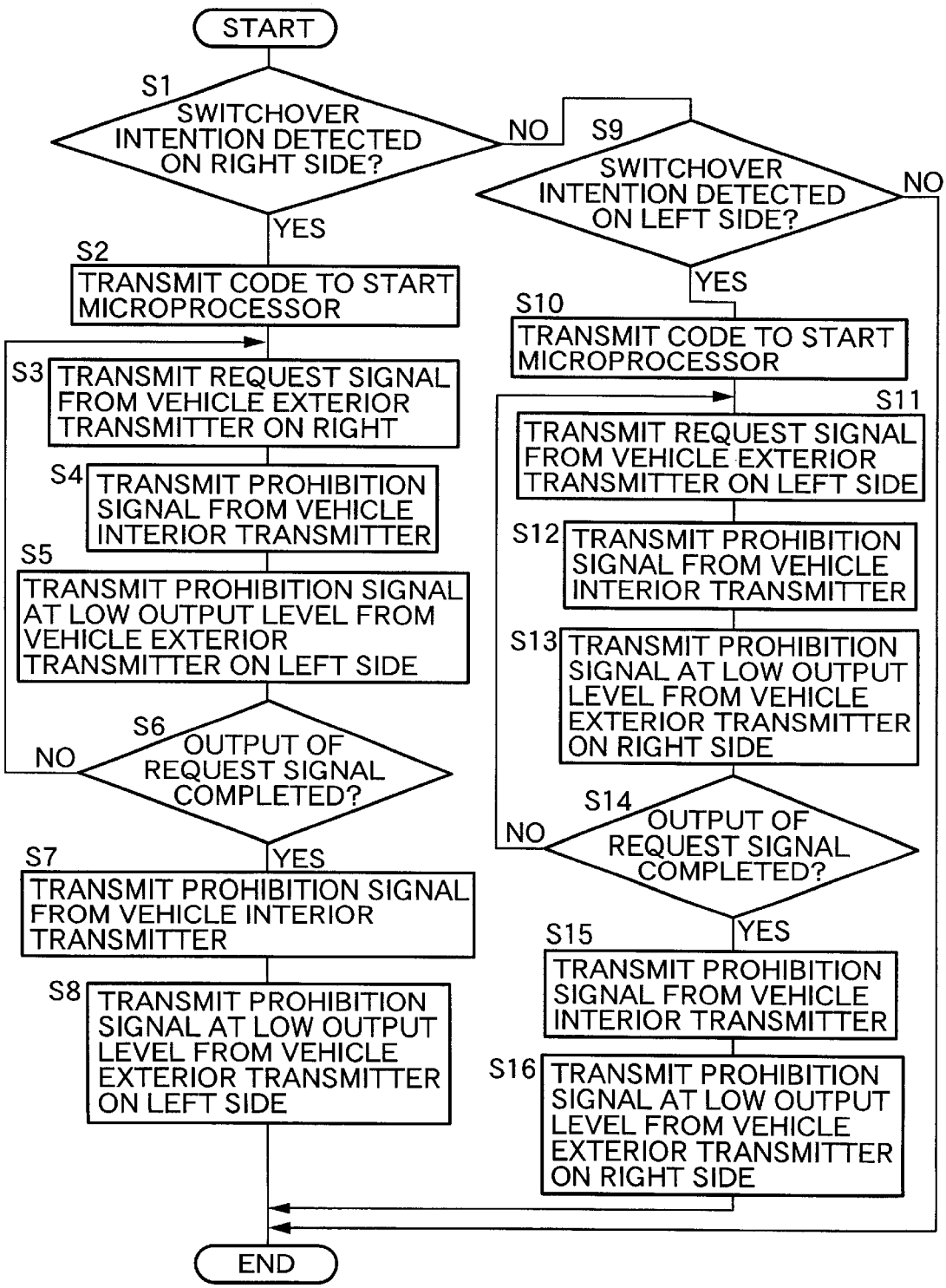

The electronic control unit 15 controls the transmissions of the transmitters 2L, 2R, and 3 according to the procedure shown in FIG. 2. In step S1, it is determined whether or not the switchover intention detection means 7R positioned on the right side of the vehicle V has detected a vehicle user's intention to switch over the locked/unlocked state of the door 5R; when the switchover intention detection means 7R has detected the vehicle user's intention to switch over, in Step 2, a start code is transmitted in step S2 from the vehicle exterior transmitter 2R on the right side of the vehicle V so as to start a microprocessor (not illustrated) installed within the portable transceiver 14.

In steps S3 to S5, a request signal in normal code is transmitted from the vehicle exterior transmitter 2R on the right side, a prohibition signal in abnormal code that is different from the normal code is transmitted from the vehicle interior transmitter 3 and, furthermore, a prohibition signal in abnormal code that is different from the normal code is transmitted from the vehicle exterior transmitter 2L on the left side at a low output level that cannot be received by the portable transceiver 14 on the right side of the vehicle V.

The transmission output from the vehicle interior transmitter 3 is set at a low level so that it cannot reach the outside of the vehicle V, and the prohibition signal output from the vehicle exterior transmitter 2L on the left side in step S5 is set at a low output level so that it cannot be received by the portable transceiver 14 carried by the vehicle user who is present on the right side of the vehicle V. That is, in steps S4 and S5, the prohibition signals output from the vehicle interior transmitter 3 and the vehicle exterior transmitter 2L on the left side are not received by the portable transceiver 14 on the right side of the vehicle V.

In step S6, it is determined whether or not the transmission of a request signal in normal code from the vehicle exterior transmitter 2R on the right side is completed, and when it is determined that it is completed, the procedure advances to step S7. By progressing through steps S3 to S6, the prohibition signals from the vehicle interior transmitter 3 and the vehicle exterior transmitter 2L on the left side are transmitted continuously while the request signal is being transmitted from the vehicle exterior transmitter 2R on the right side.

In step S7, a prohibition signal in abnormal code that is different from the normal code is transmitted from the vehicle interior transmitter 3, and in the subsequent step S8 a prohibition signal in abnormal code that is different from the normal code is transmitted from the vehicle exterior transmitter 2L on the left side. Here, the prohibition signals output from the vehicle interior transmitter 3 and the vehicle exterior transmitter 2L on the left side, as in the case of steps S4 and S5, are set at low output levels that cannot be received by the portable transceiver 14 carried by the vehicle user who is present on the right side of the vehicle V.

On the other hand, when the switchover intention detection means 7R disposed on the right side of the vehicle V does not detect in Step 1 that the vehicle user has an intention to switch over the locked/unlocked state of the door 5R, the procedure moves from step S1 to step S9. In step S9, it is determined whether or not the switchover intention detection means 7L disposed on the left side of the vehicle V has detected the vehicle user's intention to switch over the locked/unlocked state of the door 5L, and when the switchover intention has been detected by the switchover intention detection means 7L, in step S10 a start code to start the microprocessor (not illustrated) installed within the portable transceiver 14 is transmitted from the vehicle exterior transmitter 2L on the left side of the vehicle V.

In steps S11 to S13 that follow step S10, a request signal in normal code is transmitted from the vehicle exterior transmitter 2L on the left side, a prohibition signal in abnormal code that is different from the normal code is transmitted from the vehicle interior transmitter 3 at a low output level. Furthermore, a prohibition signal in abnormal code that is different from the normal code, is transmitted from the vehicle exterior transmitter 2R on the right side at a low output level that cannot be received by the portable transceiver 14 on the left side of the vehicle V.

In step S14, it is determined whether or not the transmission of the request signal in normal code from the vehicle exterior transmitter 2L on the left side is completed, and when it is determined that it is completed, in steps S15 and S16 a prohibition signal in abnormal code that is different from the normal code is transmitted from the vehicle interior transmitter 3 at a low output level and a prohibition signal in abnormal code that is different from the normal code is transmitted from the vehicle exterior transmitter 2R on the right side at a low output level that cannot be received by the portable transceiver 14 on the left side of the vehicle V.

In accordance with this transmission control procedure by the vehicle V, when the electronic control unit 15 prompts the portable transceiver 14 to transmit reply data, the electronic control unit 15 controls the transmissions of the vehicle exterior transmitters 2L and 2R and the vehicle interior transmitter 3 as follows: when the vehicle user's switchover intention is detected by one of the switchover intention detection means 7L and 7R on the left and right sides, among the vehicle exterior transmitters 2L and 2R, the vehicle exterior transmitter 2L or 2R on the side where the switchover intention detection means that has detected the switchover intention is located transmits a request signal in normal code, and prohibition signals to prohibit the transmission of reply data from the portable transceiver 14 are transmitted from the remaining vehicle exterior transmitter and the vehicle interior transmitter 3, the prohibition signals being at a low output level that cannot be received by the portable transceiver 14 that is present on the side where the switchover intention detection means that has detected the switchover intention is located, among the left and right sides on the outside of the vehicle.

Moreover in this embodiment, while the request signal is being transmitted from one of the vehicle exterior transmitters 2L and 2R, the prohibition signals are transmitted from the other one of the vehicle exterior transmitters 2L and 2R and the vehicle interior transmitter 3 and, in addition, the prohibition signals are transmitted from said other one of the vehicle exterior transmitters 2L and 2R and the vehicle interior transmitter 3 within a predetermined period of time after transmission of the request signal from said one of the vehicle exterior transmitters 2L and 2R is completed.

Figure 3:
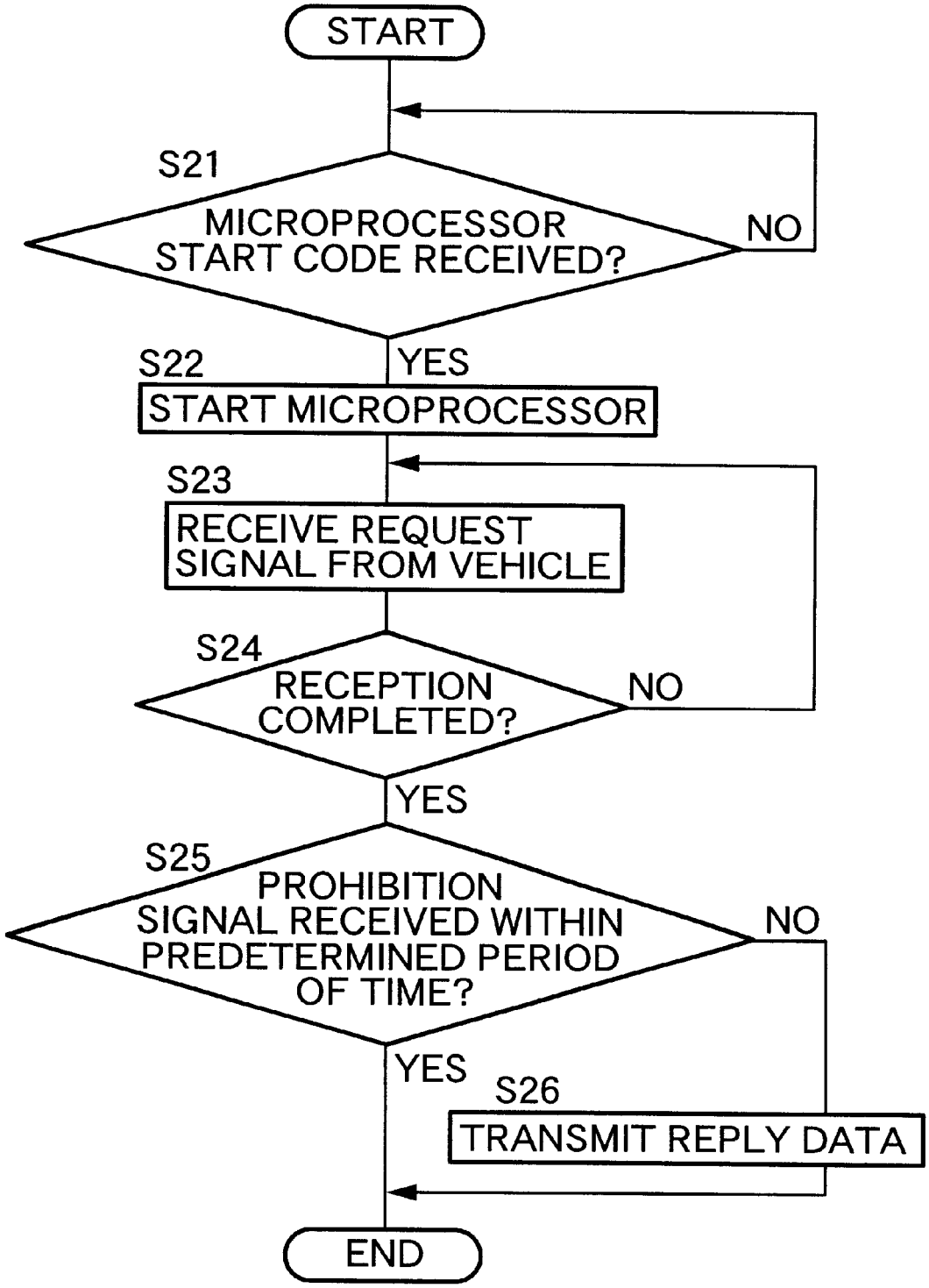

Transmission processing is carried out in the portable transceiver 14 according to the procedure shown in FIG. 3. In step S21, it is determined whether or not the start code for the microprocessor of the portable transceiver 14 has been received, and when it has been received the microprocessor is started in step S22.

Accompanying the starting of the microprocessor, after the request signal from the vehicle V side has been received in step S23, it is determined in step S24 whether or not reception of the request signal is completed; when it is determined that reception is completed, it is determined in step S25 whether or not a prohibition signal has been received during a predetermined period of time after the reception of the request signal is completed; and when it has not been received, reply data is transmitted to the vehicle receiver 4 in step S26. That is, the portable transceiver 14 transmits reply data on the condition that it has not received a prohibition signal during a predetermined period of time after receiving the request signal.

Figure 4:
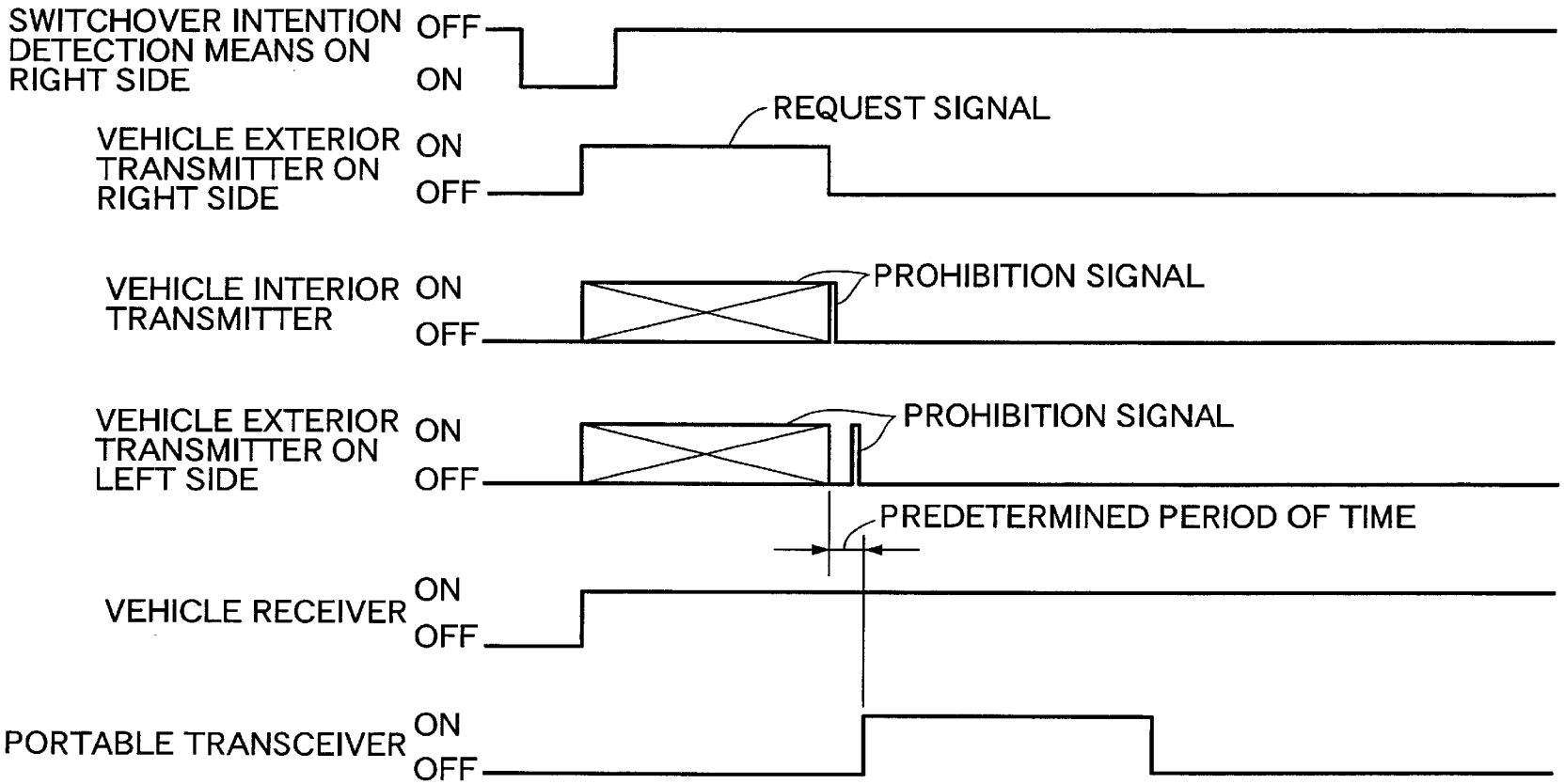

Next, the operation of this embodiment is explained. When the portable transceiver 14 is present outside the vehicle, upon detection of a vehicle user's switchover intention by the switchover intention detection means 7L and 7R mounted in the doors 5L and 5R on the left and right sides of the vehicle V respectively, among the vehicle exterior transmitters 2L and 2R, the vehicle exterior transmitter 2L or 2R that is present on the side where the switchover intention detection means 7L or 7R that has detected the switchover intention is located transmits a request signal in normal code. For example, as shown in FIG. 4, when the vehicle user carrying the portable transceiver 14 and standing on the right side of the vehicle V indicates an intention to switch over the doors 5R and 5L from the locked state to the unlocked state by operating the switchover intention detection means 7R on the right side, a request signal in normal code is transmitted from the vehicle exterior transmitter 2R on the right side, and the portable transceiver 14 that is present on the right side of the vehicle V transmits reply data to the vehicle receiver 4.

Even if there is a portable transceiver 14 on the opposite side to the switchover intention detection means 7R on the right side that has detected the switchover intention, that is, on the left side of the vehicle V, since a prohibition signal is transmitted from the vehicle exterior transmitter 2L on the left side, the portable transceiver 14 will not transmit reply data. Similarly, even if there is a portable transceiver 14 within the occupant compartment 1, since a prohibition signal is transmitted from the vehicle interior transmitter 3, reply data will not be transmitted.

It is therefore possible to quickly identify on which of the left and right sides of the vehicle V the portable transceiver 14 is located, thereby enhancing the responsiveness of system operation. Moreover, it is possible to prevent interference from any portable transceiver other than the portable transceiver 14 that has been identified as the target of communication, and it is also possible to quickly switch over the doors 5L and 5R between the locked state and the unlocked state.

Furthermore, since the prohibition signal is transmitted at a low output level that cannot be received by the portable transceiver 14 that is present on the side where the switchover intention detection means 7L or 7R that has detected the switchover intention is located, among the switchover intention detection means 7L and 7R, the prohibition signal will not interfere with communication between the vehicle receiver 4 and the portable transceiver 14 that has been identified as the target of communication.

Moreover, the electronic control unit 15 controls the transmissions from the vehicle exterior transmitters 2L and 2R and the vehicle interior transmitter 3 so as to transmit a prohibition signal within a predetermined period of time after transmission of a request signal is completed, and the portable transceiver 14 transmits reply data on the condition that it has not received any prohibition signal during the predetermined period of time after receiving the request signal. Therefore, the portable transceiver 14 transmits reply data to the vehicle receiver 4 after the predetermined period of time following completion of reception of the request signal, because the prohibition signal does not reach the portable transceiver 14 that is present on the side of either one of the switchover intention detection means 2L or 2R that has detected the switchover intention, and the other portable transceivers receive the prohibition signals and are prohibited from transmitting reply data, thereby easily identifying the portable transceiver 14 as the target of communication.

Furthermore, the electronic control unit 15 controls the transmissions from the vehicle exterior transmitters 2L and 2R and the vehicle interior transmitter 3 in such a manner that, even while one of the transmitters 2L, 2R, and 3 is transmitting a request signal, the other transmitters transmit prohibition signals. Therefore, when the portable transceiver 14 on the side where either one of the switchover intention detection means 7L or 7R that has detected the switchover intention is located, is receiving the request signal, the other portable transceivers receive the request signal and prohibition signals at the same time. That is, since the request signal is not received properly and a reply is not given, it is possible to quickly identify the portable transceiver 14 that is the target of communication.

Although the present invention is explained in detail above, the present invention can be modified in a variety of ways without departing from the spirit and scope of the present invention.

For example, in the above-mentioned embodiment, even while one of the transmitters 2L, 2R, and 3 is transmitting a request signal, the other transmitters transmit prohibition signals; and, within the predetermined period of time after transmission of the request signal from said one of the transmitters 2L, 2R, and 3 is completed, the other transmitters transmit prohibition signals; but it is also possible to select only one transmission thereof.

The switchover intention detection means 7L and 7R are designed to detect the vehicle user's intention to switch over from the locked state to the unlocked state when the user gets into the vehicle as well as to detect an intention to switch over from the unlocked state to the locked state when the user gets out of the vehicle, but the detection can be designed so that the intention to switch over from the locked state to the unlocked state can be detected at least when the user gets into the vehicle.

It is also possible to provide a plurality of vehicle interior transmitters 3 arranged within the occupant compartment 1 of the vehicle V, thereby carrying out more detailed control.

Furthermore, in the above-mentioned embodiment, when one of the switchover intention detection means on the left and right sides detects a switchover intention, prohibition signals are output from the vehicle interior transmitter and from the vehicle exterior transmitter on the side where the other switchover intention detection means is located, but a prohibition signal may be output from either the vehicle exterior transmitter or the vehicle interior transmitter so as to cover the occupant compartment.

What is claimed is:

1. A vehicle equipment remote control system comprising:

vehicle exterior transmitters disposed on at least both left and right outer sides of an occupant compartment in a vehicle;

a vehicle interior transmitter disposed within the occupant compartment;

a vehicle receiver disposed in the vehicle;

a portable transceiver that transmits reply data in response to reception of a request signal requesting reply data from each of the transmitters;

door lock means for switching over doors on both the left and right sides of the vehicle between a locked state and a unlocked state;

switchover intention detection means that are mounted in the doors on the left and right sides and can detect a vehicle user's intention to switch over the doors between the locked state and the unlocked state; and an electronic control unit mounted in the vehicle so as to control the operation of the door lock means in response to the detection output of the switchover intention detection means and the reception output of the vehicle receiver and to control the transmission from the vehicle exterior and interior transmitters;

wherein, when the vehicle prompts the transmission of reply data from the portable transceiver, the electronic control unit controls the transmissions from the vehicle exterior transmitters and the vehicle interior transmitter such that, if one of the switchover intention detection means on the left and right sides detects the vehicle user's intention to switch over the doors between the locked state and the unlocked state, the vehicle exterior transmitter on the side where the switchover intention detection means that has detected the switchover intention is located transmits a request signal requesting reply data, and at least one of the remaining vehicle exterior transmitter and the vehicle interior transmitter transmits a prohibition signal to prohibit the transmission of reply data from the portable transceiver, the prohibition signal being at a low output level that cannot be received by the portable transceiver that is present on the side where the switchover intention detection means that has detected the switchover intention is located, among the left and right sides on the outside of the vehicle.

2. The vehicle equipment remote control system according to claim 1, wherein the electronic control unit controls the transmission of the vehicle exterior transmitters and the vehicle interior transmitter so as to transmit the prohibition signal within a predetermined period of time after transmission of the request signal is completed, and the portable transceiver transmits reply data on the condition that it has not received the prohibition signal during the predetermined period of time after receiving the request signal.

3. The vehicle equipment remote control system according to claim 1 or 2, wherein the electronic control unit controls the transmission from the vehicle exterior transmitters and the vehicle interior transmitter by transmitting the prohibition signal during transmission of the request signal.

* * * * *